US007271818B2

(12) United States Patent
Mason

(10) Patent No.: US 7,271,818 B2
(45) Date of Patent: Sep. 18, 2007

(54) THERMAL TRANSFER PRINTING SYSTEM AND METHOD WITH IMPROVED PRINT QUALITY AND PRINTHEAD LIFE IN COLD AMBIENT TEMPERATURE CONDITIONS

(75) Inventor: James L. Mason, York, PA (US)

(73) Assignees: John Marozzi, Boonton Township, NJ (US); Theresa Pugh, Parsippany, NJ (US); Barbara Batesko, Montville, NJ (US)

( * ) Notice: Subject to any disclaimer, the term of this patent is extended or adjusted under 35 U.S.C. 154(b) by 372 days.

(21) Appl. No.: 11/073,847

(22) Filed: Mar. 8, 2005

(65) Prior Publication Data

US 2006/0203018 A1 Sep. 14, 2006

(51) Int. Cl.
*B41J 2/00* (2006.01)

(52) U.S. Cl. ..... 347/196

(58) Field of Classification Search ..... 347/194, 347/195, 196; 400/14, 15

See application file for complete search history.

(56) References Cited

U.S. PATENT DOCUMENTS 4,607,262 A * 8/1986 Moriguchi et al. ..... 347/196

5,006,866 A * 4/1991 Someya ..... 347/196

OTHER PUBLICATIONS americas.kyocera.com/kicc/tph/tech_maxop.html, Maximum Operating Conditions, Kyocera web pages (5); 2000-2003.

americas.kyocera.com/kicc/tph/tech_history.html, Controlling a TPH with Driver IC History Control, Kyocera web pages (2); 2000-2003.

Maximum Operating Condition Chart (MOCC), Kyocera, Apr. 19, 2000.

Maximum Operating Condition Chart (MOCC), Kyocera, Oct. 4, 2002.

Kyocera specification sheets (3); Oct. 7, 2003.

* cited by examiner

*Primary Examiner*—K. Feggins
(74) *Attorney, Agent, or Firm*—Jacobson Holman PLLC

(57) ABSTRACT

A method of controlling a thermal transfer printhead by selectively activating the printhead heater elements at customized pulse widths specifically developed for low temperature printing applications (less than 5° C.). Through the application of specific control signal modulation levels to each of five control signals that are dependent on heater element history control data as well as print speed, the printhead produces good print quality while demonstrating excellent longevity.

19 Claims, 9 Drawing Sheets

10-20
U.S.
INSPECTED
AND PASSED BY
DEPARTMENT OF
AGRICULTURE
EST. 562
07/15/04
00695

Bell–Mark History Control Signals

Bell–Mark History Control Signals

THERMAL TRANSFER PRINTING SYSTEM AND METHOD WITH IMPROVED PRINT QUALITY AND PRINTHEAD LIFE IN COLD AMBIENT TEMPERATURE CONDITIONS

BACKGROUND OF THE INVENTION

1. Field of the Invention

The present invention is related to the field of thermal transfer printing and, more particularly, to a method of controlling heater element activation in a thermal transfer printhead for improved print quality in cold ambient temperatures while retaining good printhead life.

2. Description of the Related Art

Thermal transfer printers operate through selective heating of a plurality of microscopic heater elements within the printhead. The heater elements, when activated, produce points of heat that correspond to each of the dots in an image line that is to be printed onto a medium. The heated heater elements, when thereafter coming into contact with the ink on an adjacent ribbon, heat and transfer the ink onto the medium in points or dots corresponding with the dots in the desired image line.

To effect this selective heating in order to produce a desired image, the printhead is provided with a ceramic wafer having a plurality of integrated circuits (ICs) and heater elements mounted thereon. The ICs are used to switch the heater elements on and off in response to data, loaded into the IC for each dot, indicating whether or not that dot is to be printed. The duration of the period for which the heater element is "on" is specified by the pulse width of the current flowing to the heater element, as controlled by appropriate printer control electronics.

There are three layers of logic in a driver IC. First, a shift register array accepts the data on heater element activation. Second, a latch array freezes the data in place. Finally, NAND gates are used to switch the current to the appropriate heater elements.

A conventional logic diagram for a driver IC that switches 64 dots is provided in FIG. 1. The 64 heaters labeled H1 to H64 are assumed to be connected to a common voltage source at their top and are switched to ground (GND) as shown by the row of NAND gates. The control signals enter the shift register of the IC at DATA IN (on the left) and exit at DATA OUT (on the right). The \LATCH signal initiates transfer of the data from the shift register to the latch array. The \STROBE and BEO pins are asserted during heater element activation as will be discussed more fully hereinafter.

Other ICs connected to the left and right of the IC shown make up the total printhead, with the DATA OUT shown in FIG. 1 becoming the DATA IN of a next IC to the right (not shown). The direction of data loading is left to right when viewing the printhead with the heater element line facing the viewer and the connector directed down or toward the viewer. The \STROBE signal is asserted by the printer control electronics for the length of time the current is to flow. The line over the \STROBE and \LATCH signals indicates that these signals are active low.

The sequence of operations for printing three lines is depicted in the diagram of FIG. 2, with the meaning of the data bits being "high" to print and "low" to not print.

The printer controller presents a data bit on the DATA IN pin and pulses the CLOCK pin. The printhead copies this data bit into the leftmost shift register on the rising clock pulse, with the bits in the other shift registers shifting to the right to make room. The controller repeats this step for a number of times equal to the number of heater elements on the printhead. Typically, a 53 mm printhead has 640 heater elements or pixels, while a 128 mm printhead has 1536 heater elements or pixels. This process is summarized in the drawings for the loading of a print line of six dots, progressing from before loading in FIG. 3A, to after the first clock pulse in FIG. 3B, and to the completion of five clock pulses, when the six data bits have been completely loaded, in FIG. 3C.

Once all of the data bits have been loaded, i.e., the shift registers contain data bits for each of the heater elements, the controller pulses the \LATCH pin low, which causes the printhead to copy all of the data bits to the latch registers, as shown in FIG. 4A. As can be seen in FIG. 2, once the data is latched, the controller can begin loading data for the next line, even though the first line is still printing.

Once the data is in the latch register, the controller asserts the \STROBE and BEO (block enable out) pins. Current will flow to all heater elements having a high data bit in their latch register for as long as \STROBE is low and BEO is high. Hence, as shown in FIG. 4B, the four heater elements with high data bits are switched on with current flowing for as long as \STROBE is held low.

The BEO pin is provided as a safety feature on most printheads to prevent heater element burnout in the event the controller leaves the current switched on for too long. Particularly during power on and power off, the printer controller electronics can be unstable and accidentally assert pins low or high. However, it is unlikely that both of these pins would be accidentally asserted at the same time.

In practical application, since the printhead only makes dots, higher level depictions of images such as characters, bar codes or pictures are first reduced to lines of dots by computer software or printer electronics so that each line of dots can be printed in sequence to produce the image. As each line of target dots is printed, some, all or none of the heater elements used in the previous line may be reused in the subsequent line. Heater elements that are not reused in two subsequent lines may yet be bounded on one or both sides by neighboring heater elements that were or are being used in the last or current line, respectively. This reuse and/or adjacent relationship of heated heater elements must be taken into account when printing an image in order to avoid reaching excessive operating temperatures within the heater elements involved. More particularly, heater elements that fire frequently grow hotter over the length of the page being printed, resulting in poor print quality from larger or darker printed dots and also reduced printhead life due to continued operation at excessive temperatures. By monitoring and/or tracking heater element activation, referred to in the industry and herein as history control, different pulse widths can be applied on a dot-by-dot basis, depending upon the heat that is assumed to be present in a target or neighboring dot from its having fired on previous print lines.

On a general basis, history control features have been incorporated within prior art driver ICs to reduce the pulse width to specific heater elements when it is known that those heater elements have retained heat from firing on the previous line. Driver ICs manufactured by KYOCERA, for example, utilize five control (CONT) signal inputs. In response to each of these five signal inputs, the printer controller provides pulses of progressively shorter duration. The choice of which signal input, and hence which pulse width, to direct to each dot is made based on that dot's immediate history and the immediate history of the dots adjacent thereto.

In accordance with the five signal inputs of Kyocera, each heater element that is going to fire can be unambiguously assigned to one of five scenarios which are illustrated in FIG. 5. As shown, when a heater element meets the criteria for a given scenario, e.g., CONT 3, that heater element cannot simultaneously be in another scenario, e.g., CONT 2.

The lowermost squares in the bottom line, referred to as line 3 as being the third line in the printing sequence shown, are black, indicating that these heaters have been selected, through appropriate data bit input, to fire on this print line. The two lines of squares above line 3 show the heater element activation which occurred in the previous two image lines, with the arrow showing the direction of the printhead movement relative to the paper.

The heater element in the scenario to which the CONT 1 signal is applied is relatively cold because it did not fire in the preceding two lines. The heater element to which the CONT 5 signal is applied, by contrast, is relatively hot, having been fired in both of the preceding two lines. In order to print the two dots in line 3 with the same optical density, the print controller must hold the CONT 5 signal low for a shorter period of time than the CONT 1 signal to reduce the pulse width to the "hot" heater element.

It takes some time for heat to diffuse from a heater element that fires to an adjacent heater element that did not fire. As a result, particularly at higher print speeds, it is more important to consider the contribution from adjacent dots on the prior line than those on the present line. Hence, the heating status of adjacent dots in line 3 are not shown, as they are not taken into consideration. A representative portion of a printed image, with the sequence of printed dots providing examples of these five scenarios, is shown in FIG. 6.

While the application of varying pulse widths to the heater elements through history control has been implemented, these implementations have relied upon very general power categorization. On a practical level, problems remain, particularly under certain environmental conditions. A primary environmental condition for which the known power level inputs have proven to be ineffective is that of extreme cold, i.e., temperature conditions of 5° C. or less. These conditions are commonly encountered in meat processing facilities in which meat is stored, processed, packaged and printed in refrigerated rooms for product preservation and consumer safety.

In such cold ambient temperatures, the cooling effect of the environment upon the printer heater elements results in inadequate ink transfer. The resulting print quality is poor, being too light and lacking sufficient uniformity and definition to ensure that the printed information is and remains legible as needed to inform the customer of the package content and handling instructions. Various solutions have been attempted but have not proven successful.

One solution is to increase the power directed to the heater elements in order to heat the ink sufficiently to obtain the needed print quality. This increase in power burns out the heater elements in a short time, however, resulting in permanently poor print quality under all environmental conditions. An example of poor print quality and the underlying pixel damage resulting in such quality is provided in FIGS. 7A and 7B, respectively. This permanent damage to the printhead also results in unacceptably short printhead life. For example, using conventional KYOCERA printheads at generally elevated power levels to compensate for temperature, printhead life was reduced from about 600,000 prints to 20,000 before the number of damaged heater elements prevents usable printhead performance. Failure was catastrophic, with dozens of heater elements or pixels burned out such that print performance capability was destroyed. Given that the average purchase price for a printhead is on the order of several hundred dollars, this reduction in life and associated increase in operating cost is entirely unacceptable, particularly in view of the large daily print volume required in a commercial meat packing plant.

Recognizing the high rate of printer pixel burnout resulting from generalized increases in the power applied to the heater elements, KYOCERA provides with their printheads recommended maximum limits on pulse width for each of the five CONT signals, as summarized in Table I.

TABLE I

Manufacturer Recommended Pulse Width Limits

| speed (mm/sec) | Cont 1 usec | Conts 2&3 usec | Cont 4 usec | Cont 5 usec |
|---|---|---|---|---|
| 290 | ? | ? | ? | ? |
| 300 | 180 | 145 | 112.5 | 80 |
| 310 | 178 | 143 | 111 | 79 |
| 320 | 176 | 141 | 109.5 | 78 |
| 330 | 175 | 140 | 108.5 | 77 |
| 340 | 173 | 139 | 107 | 75 |
| 350 | 172 | 137.5 | 105.5 | 73.5 |
| 360 | 171 | 136 | 104 | 72 |
| 370 | 170 | 135 | 102.5 | 70 |
| 380 | 167 | 131 | 99.5 | 68 |
| 390 | 163 | 127 | 96.5 | 66 |
| 400 | 158 | 124 | 94 | 64 |
| 410 | 155 | 122 | 92.5 | 63 |
| 420 | 154 | 121 | 91.5 | 62 |
| 430 | 153 | 120 | 90.5 | 61 |
| 440 | ? | ? | ? | ? |

These limits are provided with the conveyed understanding that operation above the indicated thresholds will result in premature printhead failure. However, when the printhead is operated within the manufacturer recommended limits under cold conditions, unacceptable print quality is obtained as has already been noted.

Therefore, a need exists for a thermal transfer printing method that operates effectively in cold ambient temperatures to produce good print quality without undue reduction in printhead life.

SUMMARY OF THE INVENTION

In view of the foregoing, one object of the present invention is to overcome the difficulties of obtaining good print quality with a thermal transfer printer in cold ambient temperature conditions.

Another object of the present invention is to improve print quality at cold ambient temperatures through individualized increases in power to the printhead heater elements based on heater element history control and print speed.

A further object of the present invention is to provide a thermal transfer printhead capable of operating effectively for hundreds of thousands of prints in ambient temperatures of less than 5° C.

Yet another object of the present invention is to provide a set of control signals for a thermal transfer printhead that produce good print quality in cold ambient temperatures without excessive heating of, and resulting damage to, the heater elements.

In accordance with these and other objects, the present invention is directed to a method of controlling a thermal transfer printhead by which the printhead heater elements are selectively activated at customized pulse widths specifically developed for low temperature printing applications (less than 5° C.). Through the application of specific control signal modulation levels that are dependent on print speed and heater element history control data, the printhead produces good print quality while demonstrating excellent longevity.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
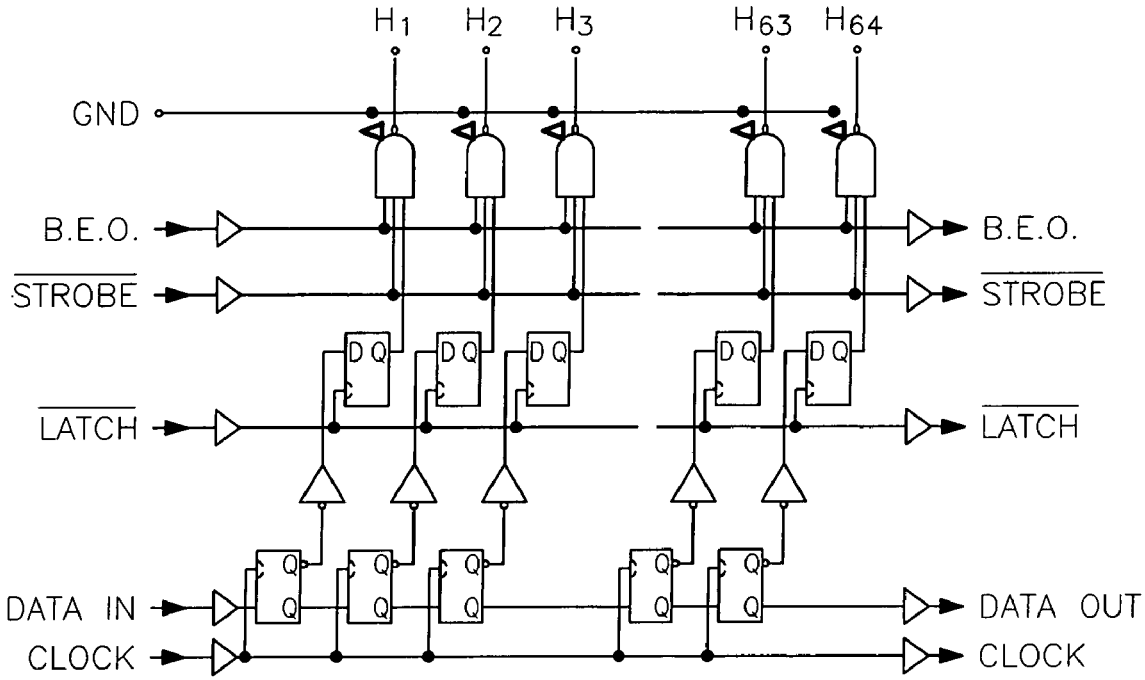
FIG. 1 (PRIOR ART)
FIG. 1 is a representative logic diagram for a driver integrated circuit (IC) switching 64 bits for a thermal transfer printer according to the prior art.
Figure 2:
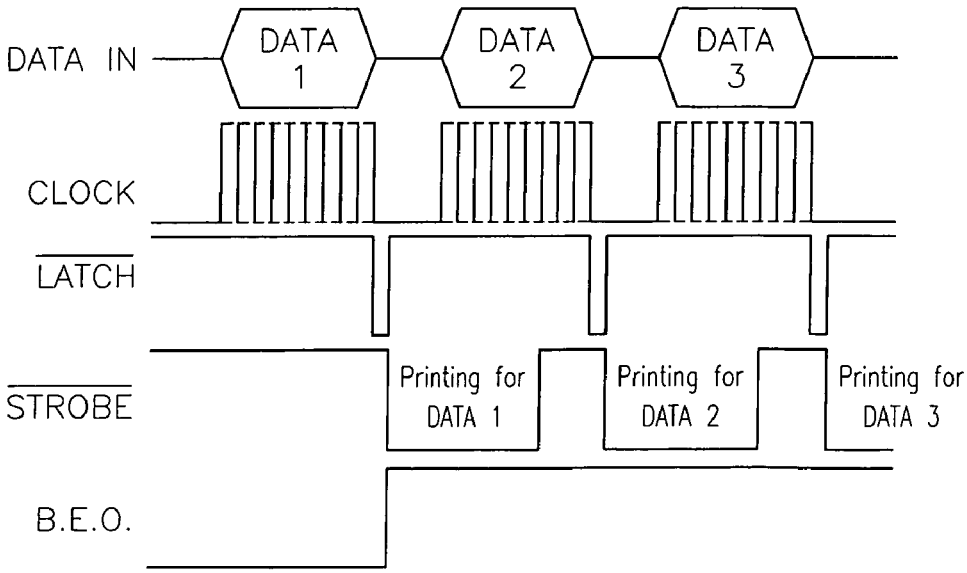
FIG. 2 (PRIOR ART)
FIG. 2 depicts the sequence of operations for printing three image lines in a conventional thermal transfer printer.
Figure 3A:
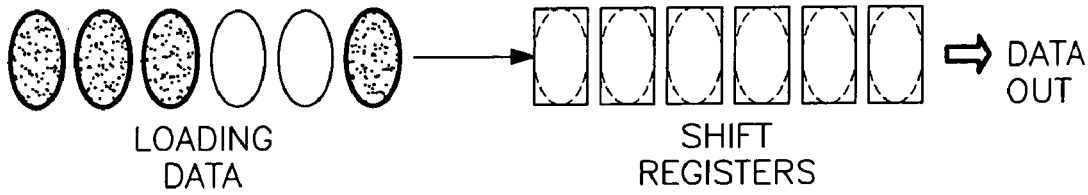
FIG. 3A (PRIOR ART)
FIGS. 3A, 3B and 3C illustrate various stages of print line information loading to the shift registers in a conventional thermal transfer printer.
Figure 3B:
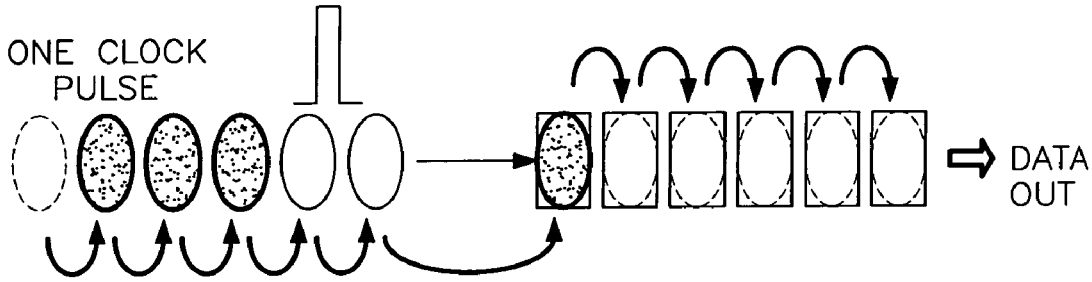
FIG. 3B (PRIOR ART)
Figure 3C:
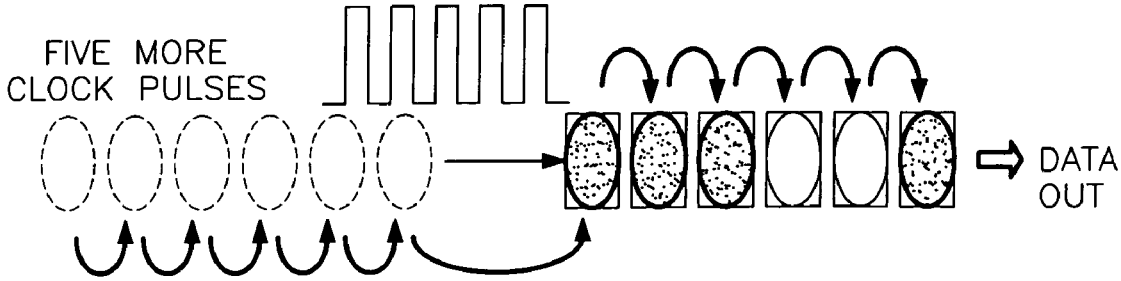
FIG. 3C (PRIOR ART)
Figure 4A:
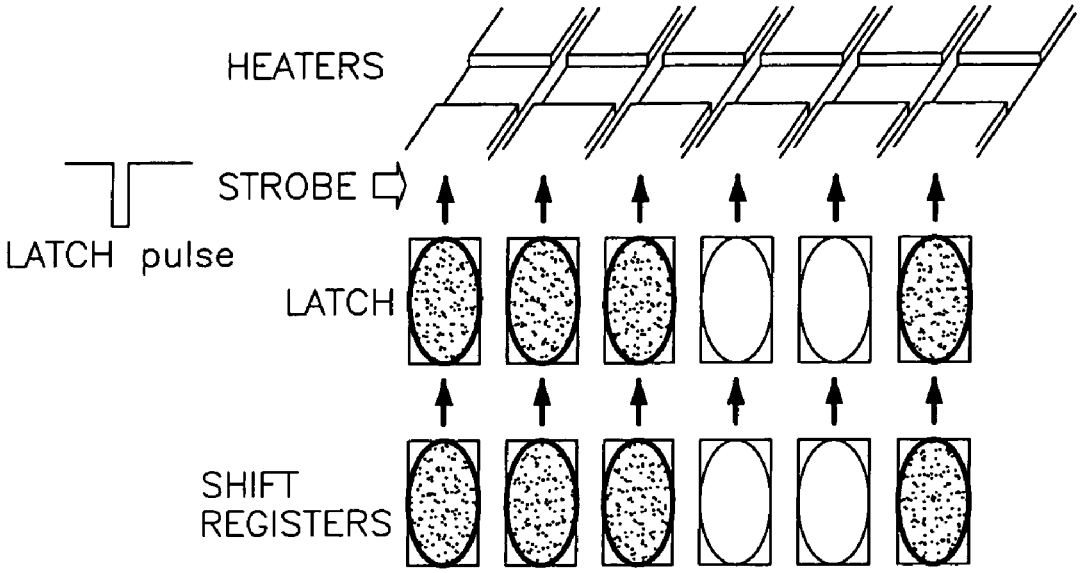
FIG. 4A (PRIOR ART)
FIG. 4A illustrates the copying of the loaded data bits of FIG. 3C to the latch registers.
Figure 4B:
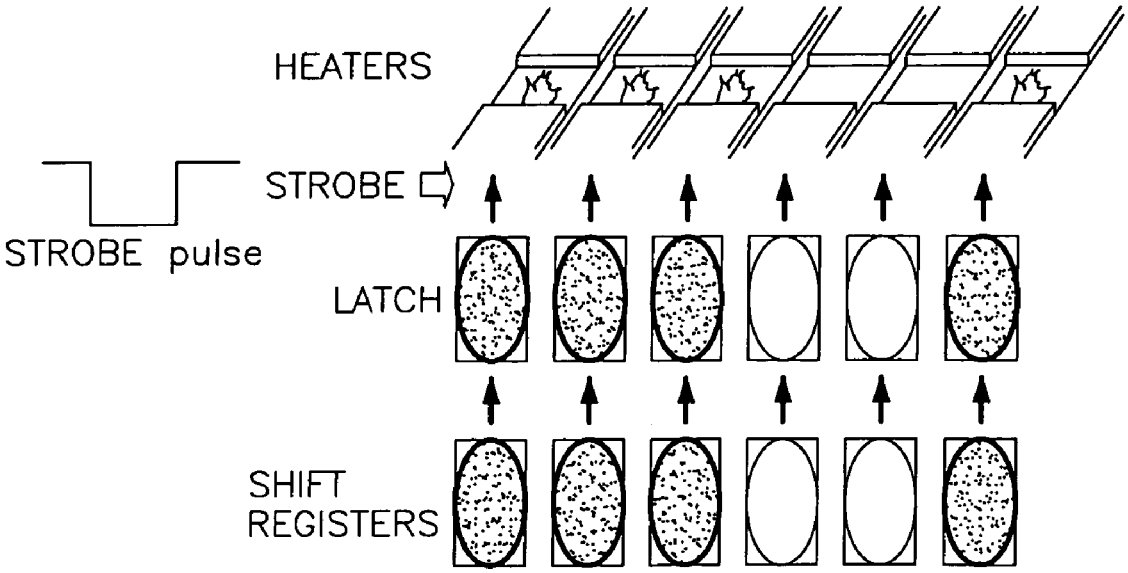
FIG. 4B (PRIOR ART)
FIG. 4B illustrates assertion of the \STROBE pin to heat respective heater elements in accordance with the latched bits of FIG. 4A.
Figure 5:
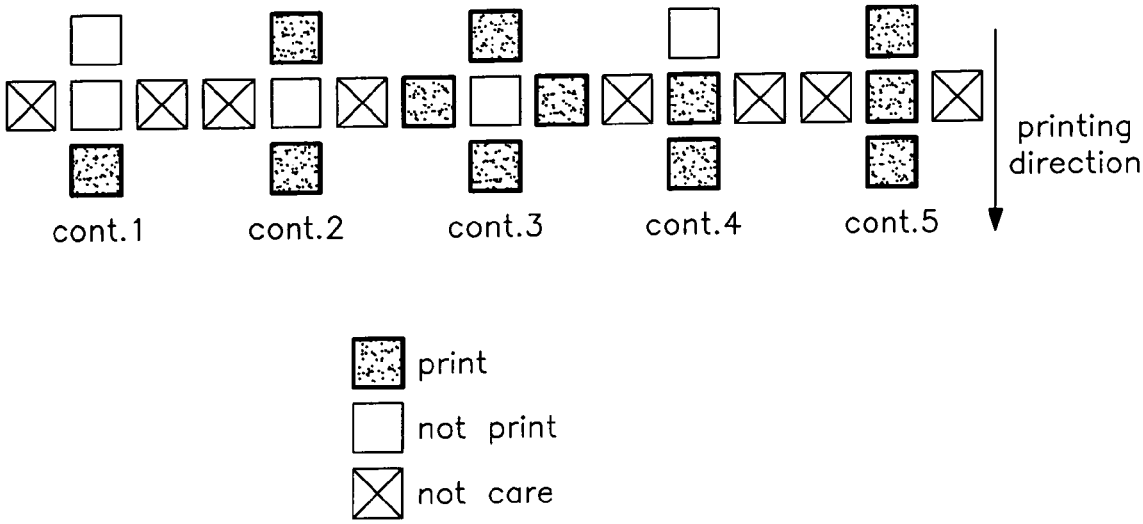
FIG. 5 (PRIOR ART)
FIG. 5 illustrates the five scenarios relating to heater element activation in previous lines of print that determine the application of the five CONT signals, respectively, according to the prior art.
Figure 6:
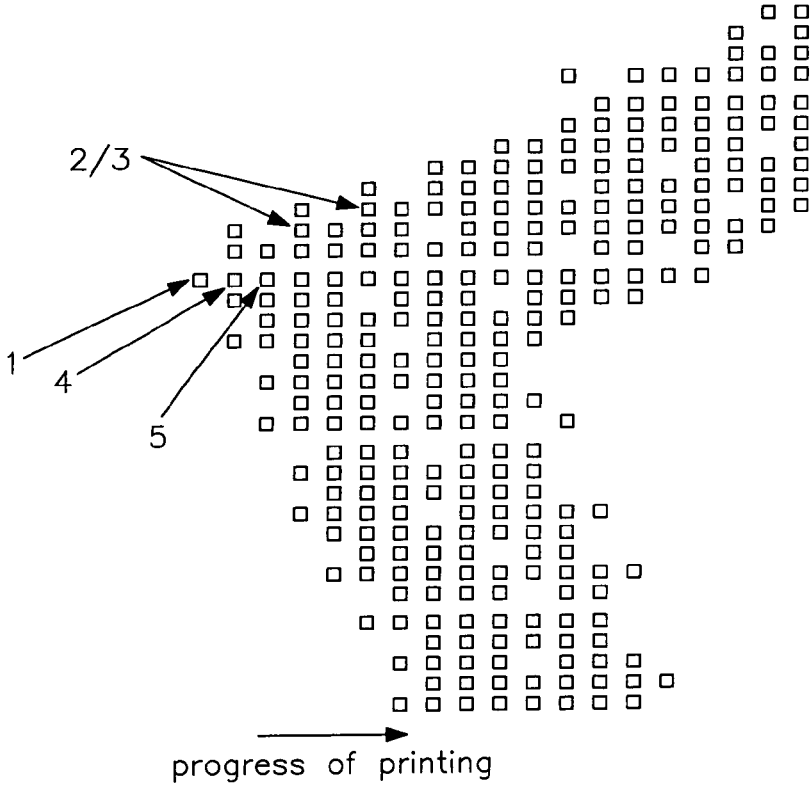
FIG. 6 (PRIOR ART)
FIG. 6 depicts a portion of a printed image broken into dots, with the sequence of printed dots providing examples of the five scenarios of FIG. 5.
Figures 7A, 7B:
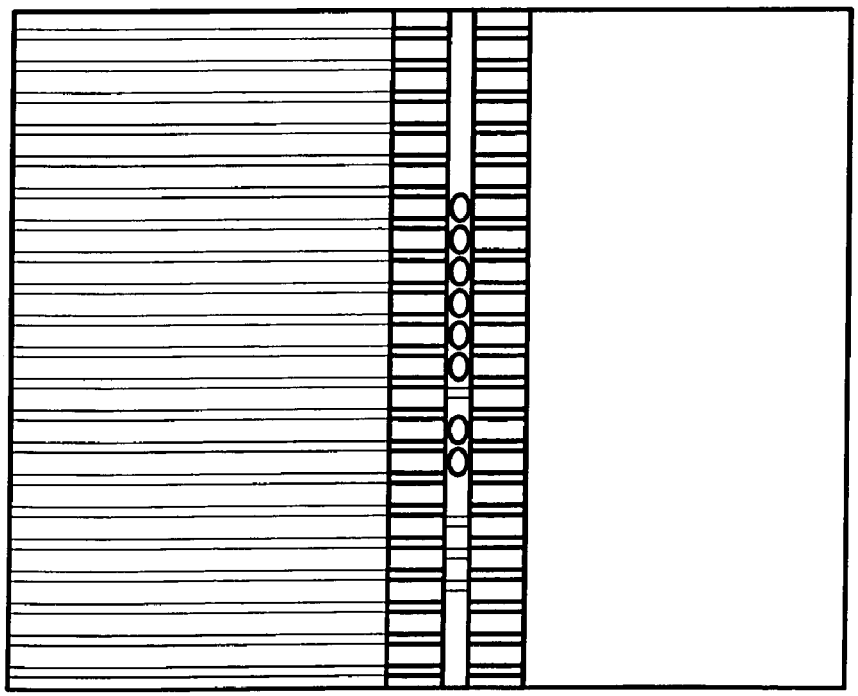
FIG. 7A (PRIOR ART)
FIG. 7B (PRIOR ART)
FIG. 7A is an example of poor print quality.
FIG. 7B is a picture of heater element damage producing the poor print quality of FIG. 7A.
Figure 8:
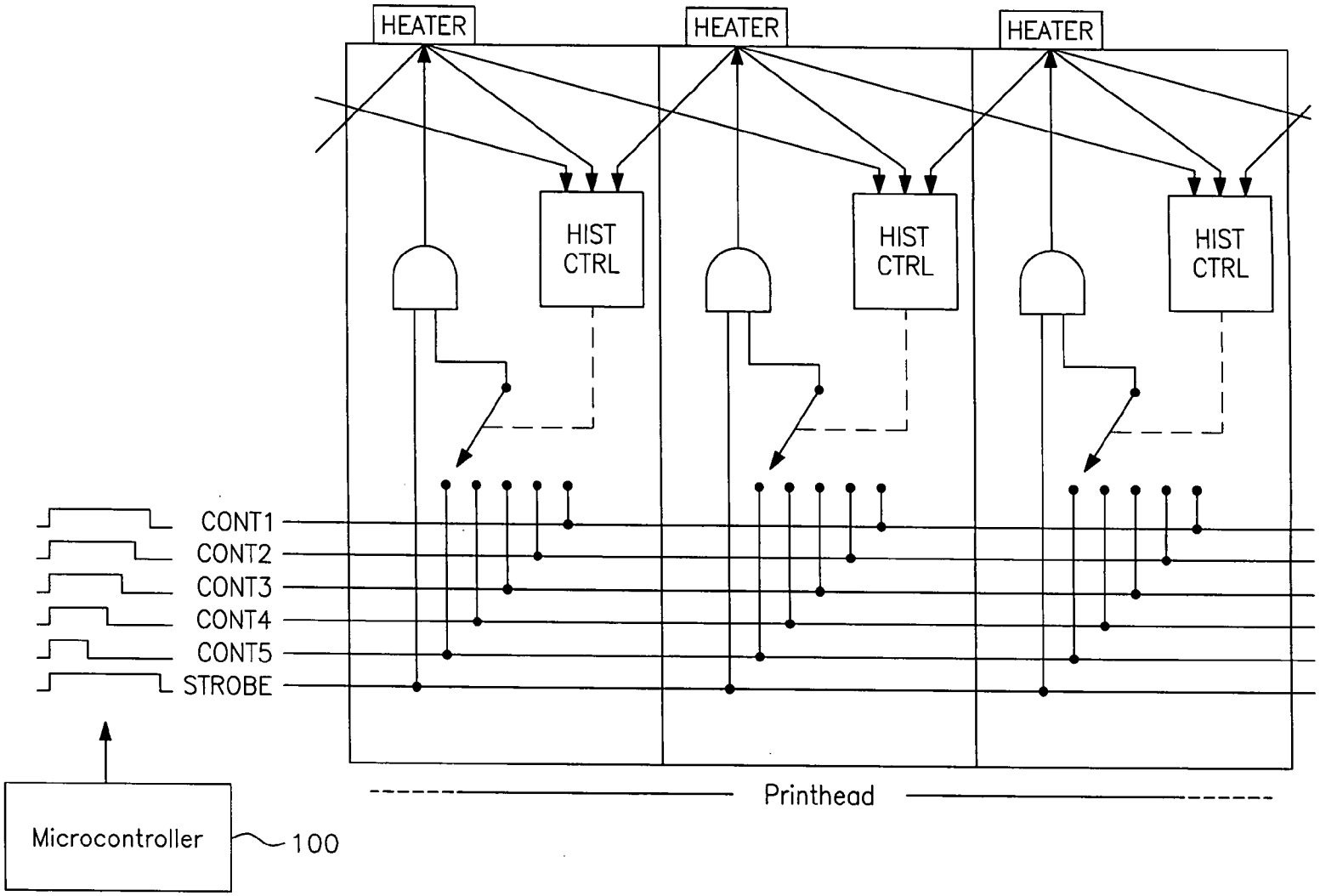
FIG. 8 is a logical block diagram of a printhead using history control data in heater element activation with the control signals being uniquely determined and input by a microcontroller in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As has already been summarized, thermal transfer printing requires selective activation of a plurality of heater elements which produce points of heat that correspond to each of the dots in an image line that is to be printed. The ink in an adjacent ribbon is heated by the heater elements and transferred onto a printing medium in dots corresponding with the dots in the image line being printed.

The present invention utilizes a method of thermal transfer printing that corresponds with the general principles already described. As summarized in the logical block diagram of FIG. 9, the driver IC according to the present invention switches a heater element "on" as long as the corresponding CONT signal is low, \STROBE is low, BEO is high, and the data bit in the latch register is high. Data is loaded and latched in the same way as was previously described herein, with the CONT1 through CONT5 signals determining the five different pulse widths. The \STROBE signal, which conventionally fires all selected heaters for the same amount of time, is provided as a convenience but does not determine the actual pulse width.

Unlike the prior art, however, the pulse width applied by each of the CONT signals is uniquely determined and directed by the microcontroller 100 according to highly tailored, experimentally derived, control data. Based on this data, the microcontroller 100 furnishes five individualized control signals that respectively constitute the content of the CONT1 through CONT5 signals to be applied to the printhead heater elements according to the history control data and print speed. According to each of these control signals, a specific pulse width is identified for a plurality of printhead speeds. The pulse width values for printhead speeds ranging from 50 mm/sec to 450 mm/sec, in intervals of 10 mm/sec, are set forth in Table II. This table, or a comparable table summarizing the listed data, is placed in RAM as part of the printer control software and can be modified manually or by parameter statements as would be known by persons of ordinary skill in the art.

TABLE II

| | | Improved Pulse Width Values | | | |
|---|---|---|---|---|---|
| X Speed | Tcyc | $Y_1$ for Cont 1 | $Y_{23}$ for Cont 2&3 | $Y_4$ for Cont 4 | $Y_5$ for Cont 5 |
| 50 | 1667 | 200 | 222 | 241 | 170 |
| 60 | 1389 | 203 | 216 | 228 | 161 |
| 70 | 1190 | 206 | 209 | 217 | 152 |
| 80 | 1042 | 209 | 205 | 209 | 145 |
| 90 | 926 | 213 | 199 | 200 | 139 |
| 100 | 833 | 215 | 194 | 192 | 133 |
| 110 | 758 | 217 | 189 | 185 | 128 |
| 120 | 694 | 219 | 185 | 180 | 122 |
| 130 | 641 | 221 | 181 | 176 | 118 |
| 140 | 595 | 223 | 179 | 172 | 114 |
| 150 | 556 | 224 | 176 | 168 | 111 |
| 160 | 521 | 225 | 173 | 165 | 107 |
| 170 | 490 | 225 | 170 | 160 | 104 |
| 180 | 463 | 226 | 168 | 157 | 100 |
| 190 | 439 | 226 | 166 | 153 | 98 |
| 200 | 417 | 225 | 164 | 149 | 95 |
| 210 | 397 | 225 | 162 | 146 | 93 |
| 220 | 379 | 223 | 160 | 143 | 90 |
| 230 | 362 | 221 | 158 | 141 | 88 |
| 240 | 347 | 219 | 156 | 138 | 87 |
| 250 | 333 | 217 | 154 | 135 | 86 |
| 260 | 321 | 215 | 152 | 132 | 85 |
| 270 | 309 | 212 | 150 | 129 | 84 |
| 280 | 298 | 209 | 148 | 127 | 82 |
| 290 | 287 | 206 | 146 | 124 | 81 |
| 300 | 278 | 203 | 144 | 122 | 80 |
| 310 | 269 | 200 | 142 | 120 | 79 |
| 320 | 260 | 197 | 140 | 118 | 77 |
| 330 | 253 | 194 | 138 | 116 | 76 |
| 340 | 245 | 192 | 136 | 115 | 75 |
| 350 | 238 | 189 | 134 | 113 | 74 |
| 360 | 231 | 186 | 133 | 111 | 72 |

TABLE II-continued

| X Speed | Tcyc | Improved Pulse Width Values $Y_1$ for Cont 1 | $Y_{23}$ for Cont 2&3 | $Y_4$ for Cont 4 | $Y_5$ for Cont 5 |
|---|---|---|---|---|---|
| 370 | 225 | 184 | 131 | 110 | 71 |
| 380 | 219 | 181 | 130 | 108 | 70 |
| 390 | 214 | 177 | 129 | 106 | 69 |
| 400 | 208 | 174 | 128 | 105 | 68 |
| 410 | 203 | 171 | 126 | 104 | 67 |
| 420 | 198 | 168 | 125 | 103 | 67 |
| 430 | 194 | 166 | 124 | 101 | 66 |
| 440 | 189 | 164 | 123 | 100 | 66 |
| 450 | 185 | 162 | 122 | 99 | 65 |

Figure 9:
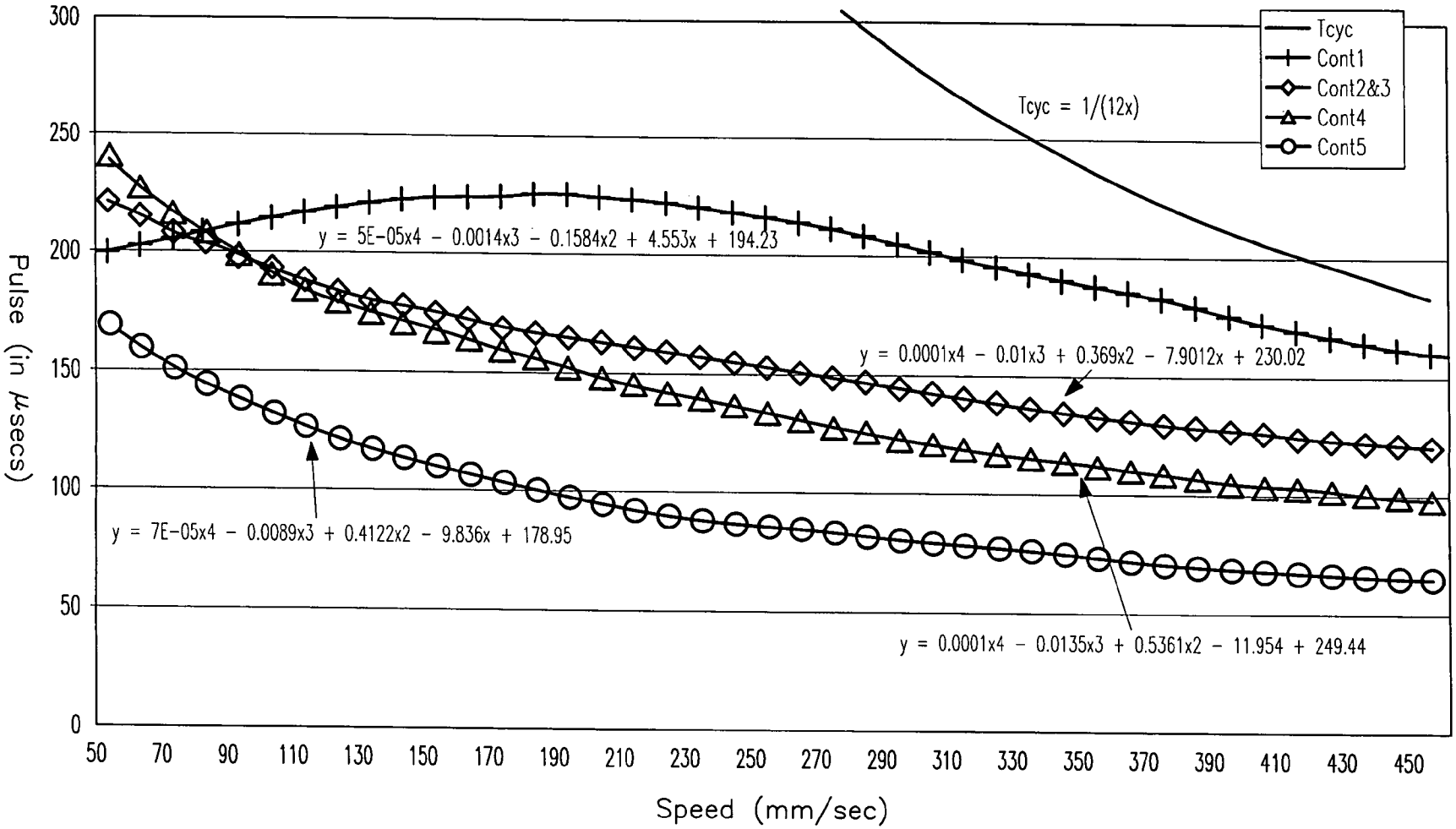
FIG. 9 is a graph plotting the graphical relationship of the pulse width data points across a range of printhead speeds for the five control signals as generated by the microcontroller of FIG. 8.

The curves which result from the graphical relationship of the pulse width data points across the range of printhead speeds summarized in Table II, are illustrated in FIG. 9. The data points were obtained experimentally through extensive testing of the printhead under cold conditions. When good print was achieved, i.e., print in which adequate ink is effectively transferred for legibility, a life test was conducted on a Bell-Mark 32 bit Continuous Easy Print Thermal Transfer Printer with a two inch printhead in a cold room held at 38° F. to 42° F. Over the course of 500,000 prints, only five pixels burned out, each occurring at 152,000 prints, 200,000 prints, 210,000 prints, 260,000 prints, and 360,000 prints, respectively.

The underlying formulas that may be used to generate the curves shown in FIG. 9 may be expressed as follows:

$$CONT1=0.00005x^4-0.0014x^3-0.1584x^2+4.553x+194.23$$

$$CONT2/3=0.0001x^4-0.01x^3+0.369x^2-7.9012x+230.02$$

$$CONT4=0.0001x^4-0.0135x^3+0.5361x^2-11.954x+249.44$$

$$CONT5=0.00007x^4-0.0089x^3+0.4122x^2-9.836x+178.95$$

These formulas were generated using an EXCEL curve-fitting function which was applied to the experimental data. A fourth order expression was chosen to obtain the desired accuracy. Alternatively, the formulas could be expressed with greater or lesser accuracy by designating, for example, fifth or third order expressions, respectively, as would be known by persons of ordinary skill in the art. Accordingly, the control signals are not specifically limited to the precise formulas but are intended to include non-significant variations therein.

Figure 10:
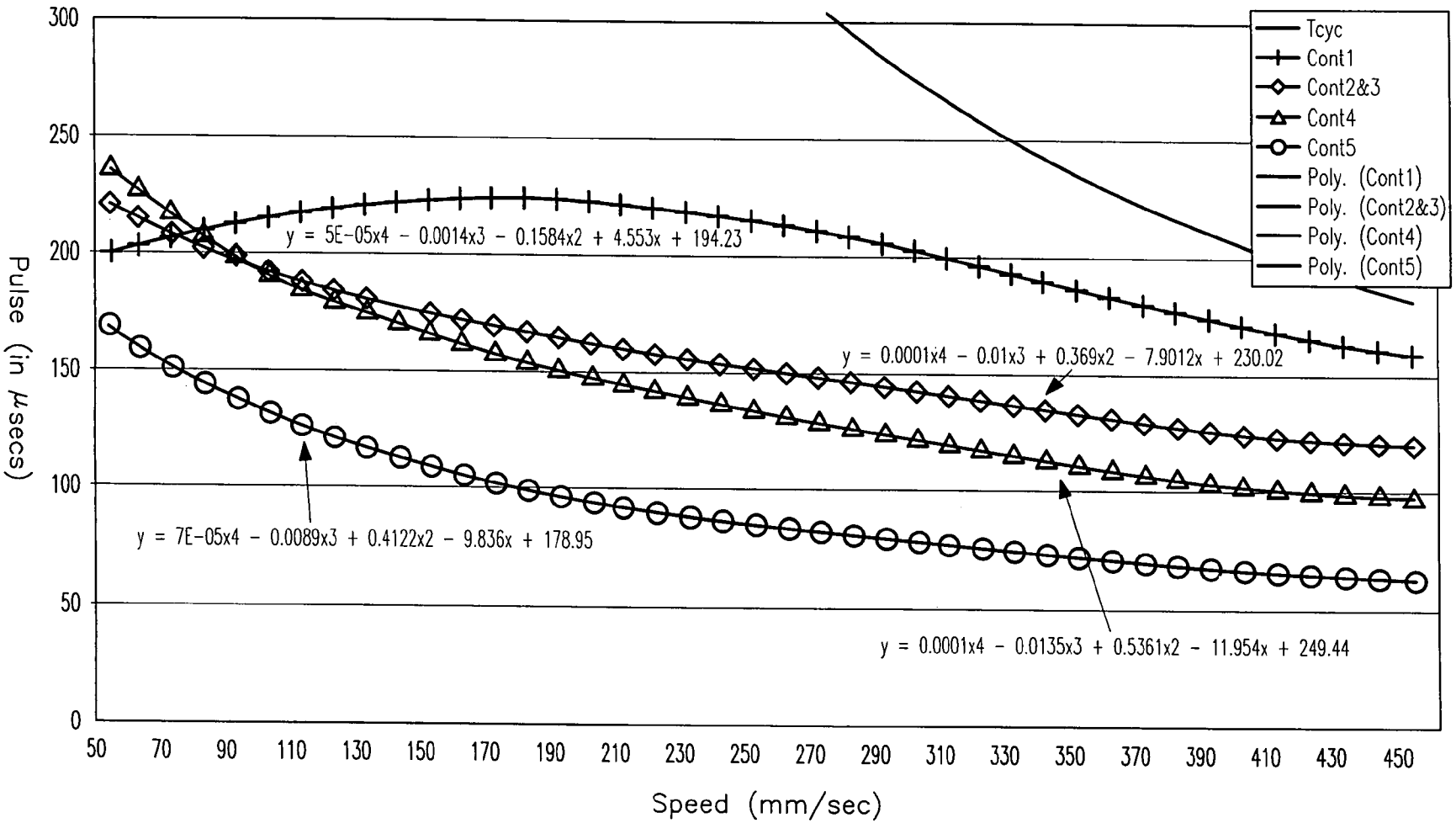
FIG. 10 is the graph of the data of FIG. 9, including the accuracy of the curve-fitting formulas generated thereon.

The accuracy of the formulas in representing the experimental data can be seen in FIG. 10 in which the curves obtained from the formulas are shown by the solid lines identified as "poly". As shown, the "poly" lines correlate very closely with the curvature of the experimental data.

Figure 11:
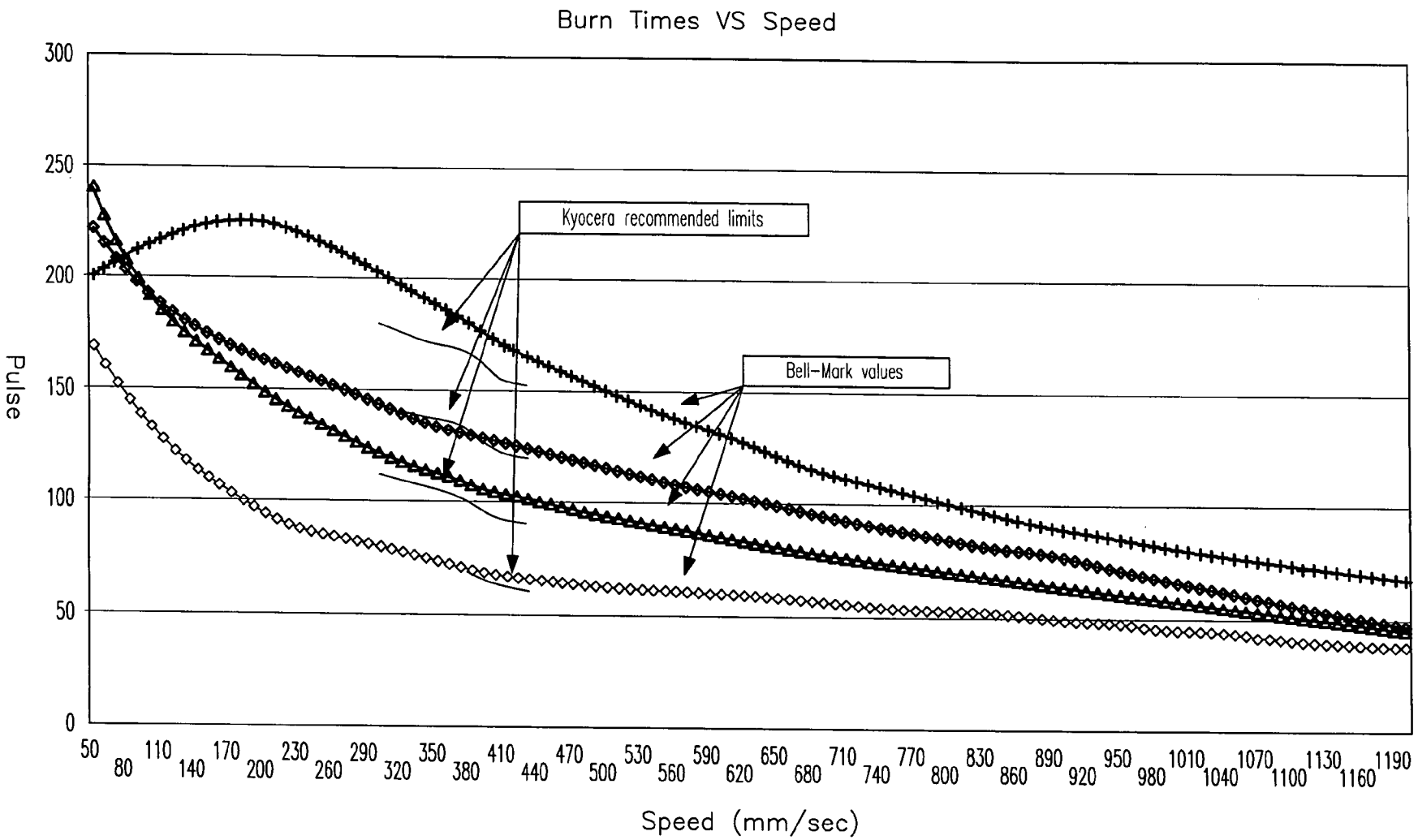
FIG. 11 is a graph plotting the pulse width data points across a wider range of printhead speeds and showing, in comparison, the manufacturer recommended pulse width limits.

A comparison of the power levels or pulse widths applied through each of the five control signals according to the present invention as against the recommended manufacturer limits, previously summarized in Table I, is shown graphically in FIG. 11. As can be seen, according to the present invention, the pulse widths of the first and fourth control signals are increased with respect to the recommended limits, while the pulse widths of the second/third and fifth control signals are substantially maintained.

More particularly, as summarized in Table III, the reference pulse width for the first reference control signal is increased by about 6-8% to generate the first control signal pulse width according to the present invention. Similarly, the reference pulse width for the fourth reference control signal is increased by about 3-5% to generate the fourth control signal pulse width according to the present invention. Percentage increases are calculated on the basis of the Tcycle, which is the time that exists between image dot burns, i.e., between heat activation of the relevant heater elements to print corresponding image dots for each line. At a print speed of 320 mm/sec, for example, the Tcycle is 260 μsec which means that the maximum pulse width, using 100% of the Tcycle, is also 260 μsec. Similarly, at a print speed of 400 mm/sec, there are 208 μsec of available cycle time.

TABLE III

| Speed (mm/sec) | Tcyc | Ref. Cont 1 usec | Pulse Width as Percentage of Tcycle Ref. 1 % of Tcyc | Cont 1 usec | Cont 1 % of Tcyc | Ref. Cont 4 usec | Ref. 4 % of Tcyc | Cont 4 usec | Cont 4 % of Tcyc |
|---|---|---|---|---|---|---|---|---|---|
| 300 | 278 | 180 | 65 | 203 | 73 | 241 | 40 | 122 | 44 |
| 310 | 269 | 178 | 66 | 200 | 74 | 228 | 41 | 120 | 45 |
| 320 | 260 | 176 | 68 | 197 | 76 | 217 | 42 | 118 | 45 |
| 330 | 253 | 175 | 69 | 194 | 77 | 209 | 43 | 116 | 46 |
| 340 | 245 | 173 | 71 | 192 | 78 | 200 | 44 | 115 | 47 |
| 350 | 238 | 172 | 72 | 189 | 79 | 192 | 44 | 113 | 47 |
| 360 | 231 | 171 | 74 | 186 | 81 | 185 | 45 | 111 | 48 |
| 370 | 225 | 170 | 76 | 184 | 82 | 180 | 46 | 110 | 49 |
| 380 | 219 | 167 | 76 | 181 | 83 | 176 | 45 | 108 | 49 |
| 390 | 214 | 163 | 76 | 177 | 83 | 172 | 45 | 106 | 50 |
| 400 | 208 | 158 | 76 | 174 | 84 | 168 | 45 | 105 | 50 |
| 410 | 203 | 155 | 76 | 171 | 84 | 165 | 46 | 104 | 51 |
| 420 | 198 | 154 | 77 | 168 | 85 | 160 | 46 | 103 | 52 |
| 430 | 194 | 153 | 79 | 166 | 86 | 157 | 47 | 101 | 52 |

While the first and fourth control signal pulse widths are increased, as just summarized, the second/third and fifth control signal pulse widths are essentially maintained with only limited variation as compared with the recommended limits. This highly selective adjustment in the relative pulse widths applied to the various control signals, increasing some while maintaining others, may appear to be quantitatively insubstantial so as to be of no qualitative significance. Yet the results obtained, which are both completely unexpected and which solve a long-standing problem in the industry, are of great practical significance and considerable commercial value. First, through the pulse width adjustments set forth herein, good print quality is obtained even at temperatures of less than 5° C. This allows meat (or other cold product) processing, packaging and printing operations to all be completed in a single refrigerated facility, securing both maximum product safety and processing efficiency. Second, through the selectivity of the power increases, the good print quality is obtained without the premature burnout of vast numbers of the printhead pixels that otherwise occurs when power levels are indiscriminately increased to all of the control signals. Neither of these benefits obtained by the present invention were possible when the printhead was operated conventionally in accordance with the manufacturer suggested limits in a cold temperature environment.

In addition, the manufacturer's reference power level limits of Table I provide data for a print speed range of from between 300 mm/sec and 430 mm/sec only, with no data being available to indicate how the power levels should be adjusted when operating the printhead at print speeds outside these ranges. As is evident from the "anomalous" portions of the curves in FIGS. 9-11, this lack of data is significant in that the limits provided for the indicated range (300 mm/sec and 430 mm/sec) do not provide any suggestion of appropriate limits for other print speed ranges.

For example, the optimal pulse width or power level determined in accordance with the present invention does not vary linearly with speed. Specifically, at print speeds of greater than 180 mm/sec, the first control signal pulse width decreases with increased print speed, as would be expected due to the heating effect of heater element activation in previous image lines. However, according to the present invention, at print speeds of less than 180 mm/sec, the first control signal pulse width increases with increased print speed. There is nothing in the manufacturer limits that would suggest this variation.

As a second example, while the fourth control signal pulse width is generally less than the second/third control signal pulse width, at a print speed of less than 100 mm/sec the fourth control signal pulse width according to the present invention is greater than the second/third control signal pulse width. This also goes against what is suggested by the limited data of the manufacturer recommended pulse width limits.

Again, this non-linear adjustment in the relative pulse widths applied to the various control signals, in combination with the selective application of pulse width increases to the first and fourth control signals, produces the very significant and unexpected benefits of good print quality and good printhead life (approximately 500,000 prints) under cold operating conditions (less than 5° C.).

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. An improvement in a method of controlling a thermal transfer printhead in cold environments, the printhead having a plurality of heater elements arranged in a linear alignment for printing a corresponding number of image dots on a line-by-line basis, a selected number of said plurality of heater elements being activated within each line in accordance with an image being printed, each of said selected number being activated by one of five control signals, said printhead including a history control mechanism that tracks which heater elements have been activated in two previous image printing lines, said previous line activation determining which of said five control signals is applied to each heater element being activated in a current line, a first control signal having a first reference pulse width of 180 μsec at a print speed of 300 mm/sec, said pulse width decreasing with increasing print speed to a pulse width of 153 μsec at a print speed of 430 mm/sec, a second control signal having a second reference pulse width less than said first reference pulse width, a third control signal having a third reference pulse width equal to said second reference pulse width, a fourth control signal having a fourth reference pulse width less than said third reference pulse width, and a fifth control signal having a fifth reference pulse width less than said fourth reference pulse width, the improvement comprising:

increasing the first reference pulse width by about 6-8% to obtain a first control signal pulse width;

substantially maintaining the second and third reference pulse widths to obtain second and third control signal pulse widths, respectively;

increasing the fourth reference pulse width by about 3-5% to obtain a fourth control signal pulse width; and substantially maintaining the fifth reference pulse width to obtain a fifth control signal pulse width.

2. The improvement as set forth in claim 1, wherein the first control signal pulse width varies with print speed and is generally represented by the formula, $$CONT1 \cong 0.00005x^4 - 0.0014x^3 - 0.1584x^2 + 4.553x + 194.23,$$

where x is print speed.

3. The improvement as set forth in claim 1, wherein the second and third control signal pulse widths are a common value that varies with print speed and is generally represented by the formula, $$CONT2/3 \cong 0.0001x^4 - 0.01x^3 + 0.369x^2 - 7.9012x + 230.02,$$

where x is print speed.

4. The improvement as set forth in claim 1, wherein the fourth control signal pulse width varies with print speed and is generally represented by the formula, $$CONT4 \cong 0.0001x^4 - 0.0135x^3 + 0.5361x^2 - 11.954x + 249.44,$$

where x is print speed.

5. The improvement as set forth in claim 1, wherein the fifth control signal pulse width varies with print speed and is generally represented by the formula, $$CONT5 \cong 0.00007x^4 - 0.0089x^3 + 0.4122x^2 - 9.836x + 178.95,$$

where x is print speed.

6. The improvement as set forth in claim 1, wherein at a print speed of less than 180 mm/sec, said first control signal pulse width increases with increased print speed.

7. The improvement as set forth in claim 1, wherein at a print speed over 180 mm/sec, said first control signal pulse width decreases with increased print speed.

8. The improvement as set forth in claim 1, wherein at a print speed of less than 100 mm/sec, said fourth control signal pulse width is greater than said second and third control signal pulse widths and, at a print speed greater than 100 mm/sec, said fourth control signal pulse width is less than said second and third control signal pulse widths.

9. An improvement in a method of controlling a thermal transfer printhead in cold environments, the printhead having a plurality of heater elements arranged in a linear alignment for printing a corresponding number of image dots on a line-by-line basis, a selected number of said plurality of heater elements being activated within each line in accordance with an image being printed, each of said selected number being activated by one of five control signals, said printhead including a history control mechanism that tracks which heater elements have been activated in two previous image printing lines, said previous line activation determining which of said five control signals is applied to each heater element being activated in a current line, a first control signal having a first reference pulse width of 180 μsec at a print speed of 300 mm/sec, said pulse width decreasing with increasing print speed to a pulse width of 153 μsec at a print speed of 430 mm/sec, a second control signal having a second reference pulse width less than said first reference pulse width, a third control signal having a third reference pulse width equal to said second reference pulse width, a fourth control signal having a fourth reference pulse width less than said third reference pulse width, said fourth reference pulse width being 112.5 μsec at a print speed of 300 mm/sec and decreasing with increasing print speed to a pulse width of 90.5 μsec at a print speed of 430 mm/sec, and a fifth control signal having a fifth reference pulse width less than said fourth reference pulse width, said first reference control signal being applied to a heater element that was not fired in either of the two previous lines, said second reference control signal being applied to a heater element that was not fired in the previous line but was fired in the next to previous line, said third reference control signal being applied to a heater element that was fired in the next to previous line and that was not fired in the previous line but had two adjacent heater elements fired in the previous line, said fourth reference control signal being applied to a heater element that was fired in the previous line, and the fifth reference control signal being applied to a heater element that was fired in both the previous and next to previous lines, the improvement comprising:

increasing the first reference pulse width to obtain a first control signal pulse width, said first control signal pulse width varying with print speed such that at a print speed of less than 180 mm/sec, said first control signal pulse width increases with increased print speed and, at a print speed of greater than 180 mm/sec, said first control signal pulse width decreases with increased print speed;

substantially maintaining the second and third reference pulse widths to obtain a common second/third control signal pulse width, said second/third control signal pulse width varying with print speed such that said second/third control signal pulse width decreases with increased print speed;

increasing the fourth reference pulse width to obtain a fourth control signal pulse width, said fourth control signal pulse width varying with print speed such that said fourth control signal pulse width decreases with increased print speed; and substantially maintaining the fifth reference pulse width to obtain a fifth control signal pulse width, said fifth control signal pulse width varying with print speed such that said fifth control signal pulse width decreases with increased print speed.

10. The improvement as set forth in claim 9, wherein the first control signal pulse width is generally represented by the formula, $$\mathrm{CONT1} \cong 0.00005x^4 - 0.0014x^3 - 0.1584x^2 + 4.553x + 194.23,$$

where x is print speed.

11. The improvement as set forth in claim 9, wherein the second/third control signal pulse width is generally represented by the formula, $$\mathrm{CONT2/3} \cong 0.0001x^4 - 0.01x^3 + 0.369x^2 - 7.9012x + 230.02,$$

where x is print speed.

12. The improvement as set forth in claim 9, wherein the fourth control signal pulse width is generally represented by the formula, $$\mathrm{CONT4} \cong 0.0001x^4 - 0.0135x^3 + 0.5361x^2 - 11.954x + 249.44,$$

where x is print speed.

13. The improvement as set forth in claim 9, wherein the fifth control signal pulse width is generally represented by the formula, $$\mathrm{CONT5} \cong 0.00007x^4 - 0.0089x^3 + 0.4122x^2 - 9.836x + 178.95,$$

where x is print speed.

14. The improvement as set forth in claim 9, wherein at a print speed of less than 100 mm/sec, said fourth control signal pulse width is greater than said second/third control signal pulse width and, at a print speed greater than 100 mm/sec, said fourth control signal pulse width is less than said second/third control signal pulse width.

15. The improvement as set forth in claim 9, wherein the first control signal pulse width is increased by 6-8% over the first reference pulse width, and the fourth control signal pulse width is increased by 3-5% over the fourth reference pulse width.

16. An improvement in a method of controlling a thermal transfer printhead in cold environments, the printhead having a plurality of heater elements for printing a corresponding number of image dots on a line-by-line basis, a selected number of said plurality of heater elements being activated within each line in accordance with an image being printed, each of said selected number being activated by one of five control signals, said printhead including a history control mechanism that tracks which heater elements have been activated in two previous image printing lines, said previous line activation determining which of said five control signals is applied to each heater element being activated in a current line, a first control signal having a first reference pulse width, a second control signal having a second reference pulse width less than said first reference pulse width, a third control signal having a third reference pulse width equal to said second reference pulse width, a fourth control signal having a fourth reference pulse width less than said third reference pulse width, and a fifth control signal having a fifth reference pulse width less than said fourth reference pulse width, said first reference pulse width being generally about 75% of a maximum pulse width for printing at a given print speed as defined by a time (Tcycle) between heater element activations, said fourth reference pulse width being generally about 45% of said maximum pulse width as defined by the Tcycle, the improvement comprising:

increasing the first reference pulse width by about 6-8% to obtain a first control signal pulse width;

substantially maintaining the second and third reference pulse widths to obtain corresponding second and third control signal pulse widths, respectively;

increasing the fourth reference pulse width by about 3-5% to obtain a fourth control signal pulse width; and substantially maintaining the fifth reference pulse width to obtain a fifth control signal pulse width.

17. The improvement as set forth in claim 16, wherein at a print speed of less than 180 mm/sec, said first control signal pulse width increases with increased print speed.

18. The improvement as set forth in claim 16, wherein at a print speed over 180 mm/sec, said first control signal pulse width decreases with increased print speed.

19. The improvement as set forth in claim 16, wherein at a print speed of less than 100 mm/sec, said fourth control signal pulse width is greater than said second and third control signal pulse widths and, at a print speed greater than 100 mm/sec, said fourth control signal pulse width is less than said second and third control signal pulse widths.

* * * * *